United States Patent [19]

Schorr

[11] 4,196,916

[45] Apr. 8, 1980

[54] SKATEBOARD BODY WITH CURVILINEAR TRANSVERSE CROSS SECTION

[76] Inventor: John E. Schorr, 6575 Bluefield Pl., San Diego, Calif. 92120

[21] Appl. No.: 894,999

[22] Filed: Apr. 10, 1978

[51] Int. Cl.[2] ..... A63C 17/02

[52] U.S. Cl. ..... 280/87.04 A

[58] Field of Search ..... 280/87.04 A, 11.28, 280/11.1 BT, 11.27, 11.19; D34/15 AJ, 14 C

[56] References Cited

U.S. PATENT DOCUMENTS

| | | | |
|---|---|---|---|
| 200,186 | 2/1878 | Forsyth | 280/11.28 |
| D. 242,735 | 12/1976 | Candler | 280/87.04 A X |
| 3,331,612 | 7/1967 | Tietge | 280/87.04 A X |
| 3,565,454 | 2/1971 | Stevenson | 280/87.04 A |
| 3,671,055 | 6/1972 | Aarup | 280/87.01 |
| 3,795,409 | 3/1974 | Cudmore | 280/87.04 A |
| 3,995,873 | 12/1976 | Pantzar | 280/87.04 A |
| 4,029,330 | 6/1977 | Runyan, Jr. | 280/87.04 A |

FOREIGN PATENT DOCUMENTS

| | | | |
|---|---|---|---|
| 276137 | 4/1966 | Australia | 280/87.04 A |

*Primary Examiner*—Joseph F. Peters, Jr.
*Assistant Examiner*—Milton L. Smith
*Attorney, Agent, or Firm*—Price, Heneveld, Huizenga & Cooper

[57] ABSTRACT

A skateboard particularly adapted for making small radius, sharply banked turns. The skateboard body is provided with an upturned curvilinear transverse cross section with the lowest point in the transverse cross section being disposed at approximately the longitudinal centerline of the skateboard body. The highest points of the transverse cross section are disposed at approximately the outboard edge of the skateboard body. In preferred embodiments of the invention, the curvilinear transverse cross section is symmetric along the longitudinal centerline of the skateboard body and extends longitudinally along part of, or the entire length of the skateboard body. In alternate embodiments of the invention, the skateboard body may be provided with a curvilinear transverse cross section approximated by a plurality of linear cross section segments. The skateboard body constructed according to the present invention is particularly adapted for making small radius, sharply banked turns, since the upturned curvilinear transverse cross section provides greater wheel travel with a lower center of gravity than is possible with conventional skateboard body designs. With maximum wheel travel increased, tighter, or smaller radius turns are possible. Also, the curvilinear transverse cross section allows the feet of the rider to more closely parallel the riding surface.

14 Claims, 7 Drawing Figures

SKATEBOARD BODY WITH CURVILINEAR TRANSVERSE CROSS SECTION

BACKGROUND OF THE INVENTION

The invention relates generally to skateboards, and more specifically to a skateboard body particularly adapted for making small radius, sharply banked turns.

Skateboards are wheeled implements which are used for coasting along sloped surfaces. Skateboards generally comprise planar, eliptical bodies having pivoting trucks on the underside and on opposing ends of the skateboard bodies. In using a skateboard the rider stands on the upper surface of the skateboard body and the skateboard is steered and controlled by the rider varying his foot placement on the upper surface of the skateboard body.

Early skateboards were constructed of wood and supported by metal wheel assemblies or trucks similar to those used on roller skates. Recent advances in wheel construction, particularly the development of urethane rollers, provide increased traction, control and maneuverability of the skateboard. These new rollers assure accurate tracking without slippage. In addition, many skateboard bodies are now produced of glass fiber reinforced resin laminates and lightweight metals which provide added strength and resiliency. A substantial hobby cult has developed around the skateboard. Both amateur and professional users have developed a repertoire of highly difficult maneuvers and contests, such as slalom races, downhill races, and acrobatic or hotdog demonstrations and contests. This has led to a demand for skateboards capable of making small radius, sharply banked turns.

Factors presently limiting the radius of turn of skateboards relate to skateboard body design rather than truck design. Conventional truck assemblies are available which provide the degree of pivoting desired. However, it is not possible to generate this degree of pivoting with most conventional skateboard bodies because of interference between the skateboard bodies and the pivoting trucks.

With many conventional skateboard designs, the turning radius is so limited by the available wheel travel provided by the skateboard body that in order to make a sharp radius turn, the rider is forced into a pivoting maneuver involving tilting of the skateboard body, lifting the front or rear wheels off of the riding surface. With the skateboard so tilted, the rider is then capable of attempting to pivot, or spin around through a wheelie maneuver or the like, using one of the two sets of wheels as a fulcrum. This is a difficult maneuver for a neophyte skateboard rider.

Several attempts have been made in the prior art to improve the wheel travel of skateboard bodies. However, for one reason or another these solutions have been unsatisfactory. For example, in some skateboard body designs, the undersides of the boards are heavily bevelled along the entire length of the underside of the board, or at least around the wheels, to increase wheel clearance and travel. The problem with this approach is that usually only a small amount of additional wheel travel may be provided without materially weakening at least the edges of the skateboard body.

Another attempt to increase wheel travel in a skateboard body involves completely cutting away the skateboard body in the area of the four wheels. Although this approach can provide a substantial increase in wheel travel, it cuts down on the total board area and it becomes possible for the rider's feet to interfere with the pivoting of the trucks and the rotation of the wheels when the wheels come up into the cutouts.

Another approach to increasing wheel travel in a skateboard body involves adding spacers or riser pads under the pivoting truck assemblies to raise the skateboard body relative thereto. The problem with this approach is that it raises the center of gravity of the skateboard and the rider, making many maneuvers more difficult because of the added instability.

Another problem common to all of these prior art skateboard body designs is that in a sharp, short radius, highly banked turn, the angle which the top surface of the board forms with the riding surface can become quite steep. This steep angle increases the difficulty of maneuvers requiring sharp radius turns, since it is more difficult for the rider's feet to follow the board.

SUMMARY OF THE INVENTION

These and other problems in the prior art are solved by providing a skateboard body having an upturned curvilinear transverse cross section. The lowest point of the curvilinear transverse cross section is disposed at approximately the longitudinal centerline of the skateboard body. The highest points of the transverse cross section are disposed at approximately the outboard edge of the skateboard body. In preferred embodiments, the curvilinear transverse cross section is symmetric along the longitudinal centerline of the skateboard body and extends longitudinally along part of, or the entire length of the skateboard body. In alternate embodiments of the invention the curvilinear transverse cross section is approximated by a plurality of linear cross section segments. Thus, in one embodiment of the skateboard body, the skateboard body may be provided with a vee-shape transverse cross section, the apex of the vee being disposed at approximately the longitudinal centerline of the skateboard body. In other embodiments of the invention, the skateboard body may be provided with first, second and third generally linear, cross section segments, the second or middle segment being disposed between the first and third outboard segments approximately along the longitudinal centerline of the skateboard body. The included angle between segments of the vee-shaped board and the outboard segments of the board having first, second and third generally linear cross sectional segments, is an oblique angle. Any of the skateboard bodies constructed according to the present invention may be provided with transverse cross sections which taper from thick, along the longitudinal centerline of the skateboard body, to thin along the outboard edge of the skateboard body.

When a skateboard body constructed according to the present invention is combined with the identical trucks and riser pads of a prior art skateboard body, the result is a substantial increase in wheel travel and a skateboard body having a top surface which allows at least one foot to more closely parallel the riding surface. This results in the ability to make sharper radius turns with more stability for the rider. Furthermore, the increased wheel clearance provided by the present invention allows the use of shorter trucks and smaller riser pads to lower the center of gravity and further increase stability while still providing an adequate amount of wheel clearance.

DESCRIPTION OF THE PREFERRED EMBODIMENT

Figure 1:
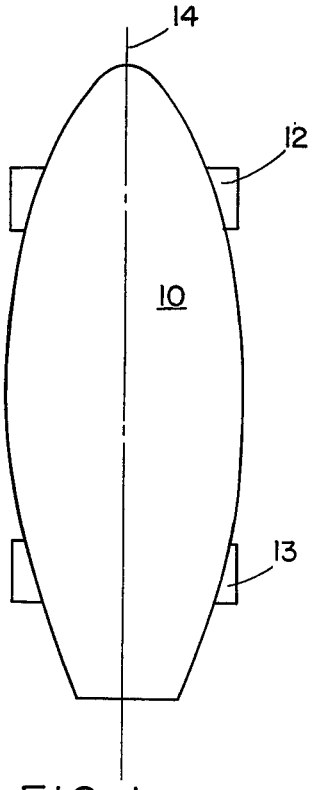
FIG. 1 is a top or planform view of a skateboard constructed according to the present invention.

FIG. 1 illustrates a planform, or top view of a generally eliptical skateboard body 10. The skateboard body 10 includes a pair of pivoting trucks or wheel assemblies on opposite ends, or adjacent the front and rear, of the underside of the body at 12 and 13, respectively. The trucks 12 and 13 are suspended in a conventional manner from the underside of the skateboard body 10 such that tilting of the skateboard body 10 about its longitudinal axis 14 will cause the trucks to pivot, generating either a left or right turn. As illustrated in FIGS. 1 through 6, the skateboard body 10 extends over and substantially covers the truck or wheel assemblies.

Figure 2:
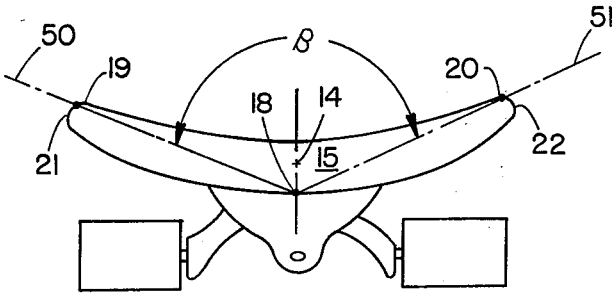
FIG. 2 is an end view of one embodiment of the invention.

Referring now to FIG. 2, an end view of a skateboard including a skateboard body 15 constructed according to the present invention is illustrated. The end view of the skateboard body 15 illustrates that the skateboard body constructed according to the present invention includes an upturned, generally curvilinear, transverse cross section. The lowest point 18 of the curvilinear transverse cross section is disposed approximately along the longitudinal centerline 14 of the skateboard body. The highest points 19 and 20 of the transverse cross section are disposed at approximately the outboard edges of the skateboard body 21 and 22. Preferably the skateboard body 15 is provided with an upturned curvilinear transverse cross section that is symmetric along the longitudinal centerline 14 of the skateboard body and which extends longitudinally along part of, or the entire length of the skateboard body. In this case, the thickness of the skateboard body 15 tapers from thick along the longitudinal centerline 14 of the skateboard body to thin along the outboard edges 21 and 22 of the skateboard body 15. The skateboard body of the present invention may be constructed from any conventional material such as wood, plastic, fiberglass reinforced resin and metal. The only difference in the construction of the board when different materials are employed, is that weaker materials will generally be provided with thicker, transverse cross sections. The skateboard body 15 illustrated in FIG. 2 has a transverse cross section proportioned in thickness in a manner appropriate for a weaker material such as wood.

Figure 3:
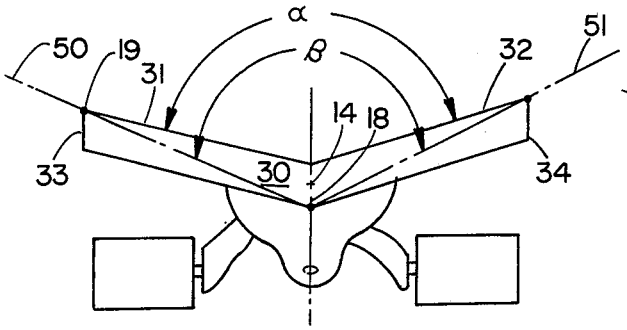
FIG. 3 is an end view of another embodiment of the invention.

Referring now to FIG. 3, an embodiment of the invention is illustrated wherein the curvilinear transverse cross section is approximated by a plurality of linear cross section segments. In this case, a skateboard body 30 is provided with two generally linear cross-sectional segments 31 and 32. Again, the lowest point 18 in the transverse cross section is disposed approximately along the longitudinal centerline 14 of the skateboard body 30. The highest points of the curvilinear transverse cross section 19 and 20 are disposed near the outboard edges 33 and 34 of the skateboard body 30. In embodiments of the invention having a vee-shaped transverse cross section, the apex of the vee is preferably disposed approximately along the longitudinal centerline 14 of the skateboard body.

Figure 4:
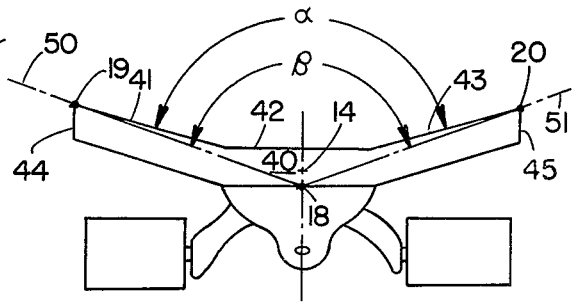
FIG. 4 is an end view of another embodiment of the invention.

Referring now to FIG. 4, another embodiment of the invention featuring a curvilinear transverse cross section approximated by a plurality of linear cross section segments is illustrated. In this case, the skateboard body 40 comprises first, second and third linear cross-sectional segments 41, 42 and 43. The second or middle, generally linear cross-sectional segment is disposed along the longitudinal centerline 14 of the skateboard body 40. In embodiments of the invention having a skateboard board with a curvilinear transverse cross section approximated by a plurality of linear cross-sectional segments whenever an even number of segments exist an apex between segments will generally be disposed along the longitudinal centerline 14 as illustrated in FIG. 3. However, whenever an odd number of generally linear cross-sectional segments is provided, generally the middle segment 42 will be centered on the longitudinal centerline 14. Referring again to the specific embodiment of FIG. 4, the highest points on the curvilinear cross section 19 and 20 are disposed near the outboard edges 44 and 45 of upturned linear segments 41 and 43 of skateboard body 40. The lowest point in the curvilinear cross section, now the surface 18 of linear cross section segment 42, is disposed along the longitudinal centerline 14 of the skateboard body 40.

In the embodiments of FIG. 3 and FIG. 4, the included angle $\alpha$ between the vee-shaped linear cross section segments 31 and 32 of FIG. 3, and the outboard linear cross-sectional segments 41 and 43 of FIG. 4 is, an oblique angle, in a range between 120° and 170°. A preferred value for the angle $\alpha$ for a wide range of riding conditions is approximately 145°.

The degree of curvature of the skateboard body of the present invention may further be generically defined by an angle $\beta$ comprising the included angle between axes 50 and 51 illustrated in FIGS. 2–4. The axis 50 is determined by a line drawn through high point 19 and low point 18 in each of the embodiments illustrated in FIGS. 2–4. The axis 51 is determined by drawing a line through high point 20 and low point 18 in each of the embodiments of the invention illustrated in FIGS. 2–4. The included angle $\beta$ between the axes 50 and 51 is generally in a range between 170° and 100°. A preferred angle for boards used for a wide range of riding conditions is approximately 135°.

Figure 5:
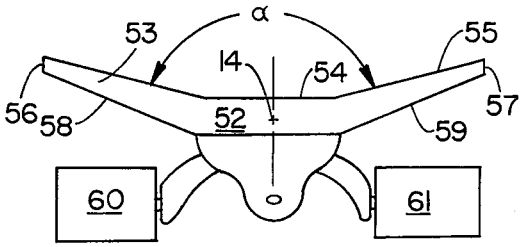
FIG. 5 is an end view of another embodiment of the invention.

FIG. 5 illustrates another embodiment of the invention wherein a skateboard body 52 is provided with a curvilinear cross section approximated by first, second and third generally linear cross-sectional segments 53, 54 and 55, respectively. In the embodiment of FIG. 5 the angle $\alpha$ is the same as that illustrated in FIG. 4. However, FIG. 5 illustrates that even with embodiments of the invention having a curvilinear cross section approximated by generally linear cross section segments, the thickness of the skateboard body 52 may taper from thick along the longitudinal centerline 14 to thin along the outboard edges 56 and 57. In this case, the change in thickness is effected by a bevel 58 and 59 on the underside of the body 52. The effect of the bevels 58 and 59 is to further increase wheel clearance for the wheels 60 and 61 and bevels such as this may also be added to the embodiments of FIGS. 2 and 3.

Figure 6:
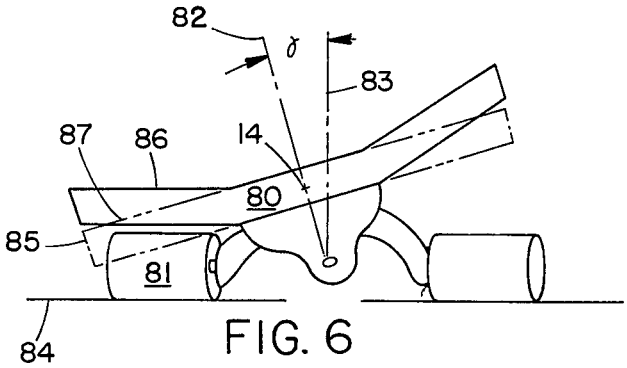
FIG. 6 is an end view of a skateboard having a skateboard body constructed according to the present invention illustrated in a sharply banked turn with a conventional skateboard body superimposed thereover in phantom.
Figure 7:
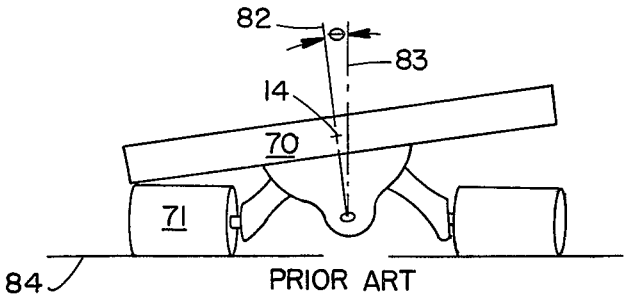
PRIOR ART FIG. 7
FIG. 7 is an end view of a skateboard employing a conventional skateboard body illustrated in a sharply banked turn.

Referring to FIGS. 6 and 7, the operation of the skateboard body constructed according to the present invention is described. In FIG. 7 a conventional skateboard body 70 is illustrated with the skateboard body tilted about its longitudinal axis 14 to the maximum degree allowed by interference between the underside of the board 70 and the wheel 71.

Referring now to FIG. 6, a skateboard having a skateboard body 80, constructed according to the present invention, is illustrated tilted to the maximum amount allowable without interference between the underside of the skateboard body 80 and the wheel 81. In the skateboards illustrated in FIGS. 6 and 7, identical trucks and riser pads are illustrated. However, comparison of the angles $\theta$ and $\gamma$ measured between the vertical centerline 82 of the skateboards and a normal line 83 of riding surface 84, illustrates that the angle $\gamma$ is clearly larger than the angle $\theta$. This is because the curvilinear skateboard body of the present invention provides much more wheel travel. Since the degree of pivoting of the trucks is directly proportional to the amount of tilt of the skateboard body about its longitudinal axis (equal to the angles $\gamma$ or $\theta$), the skateboard body of FIG. 6 is capable of achieving a much sharper or tighter radius turn. Tilting of the board to this degree is not possible with the conventional flat skateboard body as illustrated by phantom lines 85 representing the position of a conventional skateboard body at this degree of tilt. It can be clearly seen that the skateboard body sketched in phantom at 85 would interfere with wheel 81 to prevent this degree of tilt.

The increased tilt available with skateboard bodies constructed according to the present invention will increase the riding enjoyment of neophyte riders who are unable to achieve wheelie or pivoting turns by allowing them to steer smooth turns of a much sharper radius than heretofore possible. Furthermore, increased stability will be provided in the turns by virtue of the fact that at least one of the rider's feet resting on the top surface of the skateboard body 80 will be disposed on a surface 86 which much more closely parallels the riding surface 84. This should be clear from simple reference to the top surface 87 of the conventional flat skateboard body shown in phantom at 85 with the same degree of tilt. Thus, even if a conventional skateboard body were provided with cutouts or the like to allow the same degree of tilt as shown in FIG. 6, the top surface 87 of the skateboard body shown in phantom at 85 would form a rather steep angle with respect to the riding surface 84. Furthermore, although the skateboard body 80 is compared here with a conventional skateboard body having identical trucks, and riser pads, provision of a skateboard body 80 having a transverse curvilinear cross section would allow the use of lower riser pads and/or shorter trucks to effectively lower the center of gravity of the skateboard and improve stability while still allowing sufficient wheel travel for most riding conditions.

The skateboard body of the present invention may be built with a planform of any shape employing any state of the art truck, wheel, axle, or riser pad. When the skateboard body is made from wood, the body would be shaped such that the wood would retain close to its full thickness near the edge thereby retaining its full strength. If the skateboard body of the present invention is constructed from any other thinner, stronger materials, such as metal, fiberglass, or plastic, the transverse cross sections would still meet the criteria herein disclosed except that the transverse cross sections would appear somewhat thinner than those illustrated in FIGS. 2-6. When constructing the skateboard body of the present invention from metal, the present invention presents manufacturing advantages over prior art skateboard bodies designed for sharply banked turns, since the metal which the skateboard body is formed from may be easily shaped to the desired curvilinear transverse cross section without requiring bevelling of the metal or forming cutouts for the wheel wells.

The above description should be considered as exemplary and that of the preferred embodiment only. Many modifications of the present invention will occur to those skilled in the art. The true spirit and scope of the present invention is to be determined by reference to the appended claims and it is desired to include within the scope of the appended claims all such modifications of the invention that are obvious to one of ordinary skill in the art.

The embodiments of the invention in which an exclusive property or privilege is claimed are defined as follows.

1. A skateboard particularly adapted for making small radius sharply banked turns comprising:

a skateboard body;

front and rear sets of pivoting trucks and wheels disposed adjacent the front and rear of said skateboard body, respectively;

said skateboard body being provided with a length and width sufficient to extend over and substantially cover said front and rear sets of pivoting trucks and wheels to provide a large stable platform from which the rider executes turns;

an upturned curvilinear transverse cross section extending the entire length of said skateboard body to increase clearance between said skateboard body and said front and rear sets of pivoting trucks and wheels, providing for smaller turning radiuses with a low center of gravity and increased stability;

a lowest point of said transverse cross section being disposed at approximately the longitudinal centerline of said skateboard body;

a highest point of said transverse cross section being disposed at approximately the outboard edge of said skateboard body; and said skateboard body being provided with a thickness that tapers from thick along the longitudinal centerline of said skateboard body to thin along the outboard edge of said skateboard body to further increase clearance between said skateboard body and said front and rear sets of pivoting trucks and wheels.

2. The skateboard of claim 1 further including:

said skateboard body having first and second sides disposed opposite the longitudinal centerline of the skateboard body;

said transverse cross section having first and second high points, said first and second high points being disposed in said first and second sides, respectively;

a first axis including said first high point and said lowest point; and a second axis including said second high point and said lowest point;

said first and second axes being disposed with an included angle in a range between 170° and 100°.

3. The skateboard of claim 2 wherein said included angle is approximately 135°.

4. The skateboard of claim 1 wherein said curvilinear transverse cross section is symmetric along the longitudinal centerline of the skateboard body.

5. The skateboard of claim 1 wherein said curvilinear transverse cross section is approximated by providing said skateboard body with a vee-shaped transverse cross section, the apex of the vee being disposed approximately at the longitudinal centerline of said skateboard body.

6. The skateboard of claim 5 wherein the included angle of said skateboard body of vee-shaped cross section is an oblique angle.

7. The skateboard of claim 6 wherein said included angle is in a range between 120° and 170°.

8. The skateboard of claim 7 wherein said included angle is approximately 145°.

9. The skateboard of claim 1 wherein said curvilinear transverse cross section is approximated by a plurality of linear cross section segments.

10. The skateboard of claim 9 wherein said curvilinear transverse cross section is approximated by first, second and third linear cross section segments, said second segment being disposed between said first and third segments, approximately along the longitudinal centerline of said skateboard body.

11. The skateboard of claim 9 wherein the included angle between said first and third segments is an oblique angle.

12. The skateboard of claim 11 wherein said included angle is in a range between 120° and 170°.

13. The skateboard of claim 12 wherein said included angle is approximately 145°.

14. The skateboard of claim 1 wherein the underside of said skateboard body is bevelled to increase available wheel clearance.

* * * * *